United States Patent [19]

Hattori

[11] 4,211,074

[45] Jul. 8, 1980

[54] SECONDARY AIR SUPPLY SYSTEM FOR THE EXHAUST SYSTEM OF AN INTERNAL COMBUSTION ENGINE

[75] Inventor: Kyo Hattori, Susono, Japan

[73] Assignee: Toyota Jidosha Kogyo Kabushiki Kaisha, Aichi, Japan

[21] Appl. No.: 902,244

[22] Filed: May 2, 1978

[30] Foreign Application Priority Data

Feb. 6, 1978 [JP] Japan ..... 53/12156

[51] Int. Cl.[2] ..... F01N 3/10

[52] U.S. Cl. ..... 60/276; 60/289; 60/290

[58] Field of Search ..... 60/276, 289, 290

[56] References Cited

U.S. PATENT DOCUMENTS

| | | | |
|---|---|---|---|
| 4,102,126 | 7/1978 | Miyagi | 60/289 |
| 4,137,713 | 2/1979 | Takeda | 60/289 |
| 4,141,214 | 2/1979 | Mitsuda | 60/290 |
| 4,159,626 | 7/1979 | Shibata | 60/276 |

*Primary Examiner*—Douglas Hart
*Attorney, Agent, or Firm*—Stevens, Davis, Miller & Mosher

[57] ABSTRACT

A secondary air supply system for the exhaust system of an internal combustion engine having a catalytic converter with a three-way catalyst. The system has an air control valve which selectively supplies a part of compressed air to the exhaust system while relieving the rest of the air to the atmosphere. The air control valve has a first valve element which controls a passage between an inlet port and an outlet port and a second valve element which controls a passage between the inlet port and a relief port, the first valve element being controlled by a first diaphragm means in an ON/OFF manner by changing-over of supply of different actuating fluid pressures depending upon monitoring of residual oxygen in exhaust gases, while the second diaphragm element is operated by a second diaphragm means which responds to the duty ratio of changing-over of the different actuating fluid pressures so as to compensate for the change of mean flow of secondary air.

5 Claims, 3 Drawing Figures

SECONDARY AIR SUPPLY SYSTEM FOR THE EXHAUST SYSTEM OF AN INTERNAL COMBUSTION ENGINE

BACKGROUND OF THE INVENTION

The present invention relates to a secondary air supply system for the exhaust system of an internal combustion engine, and, more particularly, to an air control valve incorporated in the secondary air supply system.

In an exhaust gas purifying system which incorporates a three-way catalyst for simultaneously removing HC, CO, and NOx contained in the exhaust gases of an internal combustion engine, the air/fuel ratio of the exhaust gases must be controlled to be within a relatively narrow range of the stoichiometric air/fuel ratio in order to obtain effective performance of the three-way catalyst. Therefore, in the exhaust gas purifying system incorporating a three-way catalyst, the air/fuel ratio of engine intake mixture is set on the smaller or rich side of the stoichiometric air/fuel ratio, and the exhaust gases generated from such a mixture are supplied with secondary air while the air/fuel ratio is monitored by an oxygen detector so that the air/fuel ratio of the exhaust gases introduced into the three-way catalyst is maintained within a relatively narrow range (the window range) around the stoichiometric air/fuel ratio which is required to obtain effective performance of the three-way catalyst.

A secondary air supply system which supplies secondary air to the exhaust system of an engine for the aforementioned purpose generally comprises a source of compressed air such as an air pump driven by the engine, an air control valve which supplies a part of the air delivered from said source to the exhaust system of the engine while relieving the rest of the air, an oxygen detector for detecting residual oxygen contained in the exhaust gases flowing through the exhaust system, a source of actuating fluid pressure (for which the intake manifold generally serves to supply intake manifold vacuum as the actuating fluid pressure), a change-over valve for said actuating fluid pressure, and a controller which changes over said change-over valve in accordance with the output of said oxygen detector, said air control valve supplying the air delivered from said source of compressed air to the exhaust system as secondary air when said oxygen detector detects no residual oxygen while it stops supplying secondary air to the exhaust system while relieving the air supplied from said source of compressed air to the atmosphere, or, generally, into the air cleaner of the engine, when the oxygen detector detects residual oxygen. The air control valve incorporated in the conventional secondary air supply system generally comprises an inlet port for receiving air from a source of compressed air such as an air pump driven by the engine, an outlet port for supplying a part of the air received to the exhaust system, a relief port for relieving the rest of the air received, a first passage which connects said inlet port and said outlet port, a second passage which connects said inlet port and said relief port, a valve element which reciprocally controls the openings of said first and second passages, first and second diaphragm chambers selectively supplied with either intake manifold vacuum or atmospheric pressure by way of said change-over valve, and at least one diaphragm which defines said individual diaphragm chambers and is connected with said valve element, wherein said diaphragm is adapted so as to shift said valve element in the direction to open said first passage and to close said second passage when said first diaphragm chamber is supplied with intake manifold vacuum while said second diaphragm chamber is opened to the atmosphere, and so as to shift said valve element in the direction to open said second passage and to close said first passage when said second diaphragm chamber is supplied with intake manifold vacuum while said first diaphragm chamber is opened to the atmosphere.

The secondary air supply system for the exhaust system of an internal combustion engine which incorporates an air control valve of the aforementioned structure together with an oxygen detector, a vacuum change-over valve, and a controller which changes over said vacuum change-over valve in accordance with the output of said oxygen detector is a feedback control system which supplies additional air as the secondary air to the basic exhaust gases having an air/fuel ratio which is somewhat lower than the lower limit of the window range, whereby the air/fuel ratio of exhaust gases is controlled in a manner such that it changes in the shape of triangular pulse waves going up and down on either side of the center of the window range. The responsiveness of this feedback control system is relatively low, as in the order of a few Hertz at the greatest. Therefore, when the system is designed as a compromise between quickness of response to transient conditions and accuracy, the air/fuel ratio generally overshoots and undershoots out of the window region; i.e., the air control valve is periodically fully opened or fully closed. In such a secondary air supply system, when the mean level of basic air/fuel ratio changes from the standard level due to changes of operational condition of the engine or allowable errors in products, the difference between stoichiometric air/fuel ratio and basic air/fuel ratio changes, whereby the extent of overshooting or undershooting of air/fuel ratio relative to stoichiometric air/fuel ratio changes. As a result, the mean air/fuel ratio of exhaust gases deviates from the stoichiometric air/fuel ratio, and the accuracy of air/fuel control lowers as a whole, thereby reducing the effectiveness of the three-way catalyst. Furthermore, when the three-way catalyst has been used for such a long time that its effectiveness has lowered and the width of its window region has been reduced, this overshooting & undershooting will bring the air/fuel ratio further away from the window region, thereby further reducing the effectiveness of the three-way catalyst.

SUMMARY OF THE INVENTION

It is therefore the object of the present invention to deal with the aforementioned problems with regard to the conventional secondary air supply system for the exhaust system of an internal combustion engine, particularly the problems with regard to the conventional air control valve, and to provide an improved secondary air supply system for the exhaust system of an internal combustion engine, which operates so as to make a compensation in the supply of secondary air in accordance with changes of the mean level of basic air/fuel ratio and so as to control the supply of secondary air making the compensated secondary air flow as the standard, thus being capable of maintaining the mean air/fuel ratio of exhaust gases steadily in the close vicinity of stoichiometric air/fuel ratio in spite of changes of the mean level of basic air/fuel ratio.

BRIEF DESCRIPTION OF THE DRAWING

The present invention will become more fully understood from the detailed description given hereinbelow and the accompanying drawings, which are given by way of illustration only, and thus are not limitative of the present invention, and wherein.

DETAILED DESCRIPTION OF THE PREFERRED EMBODIMENT

Figure 1:
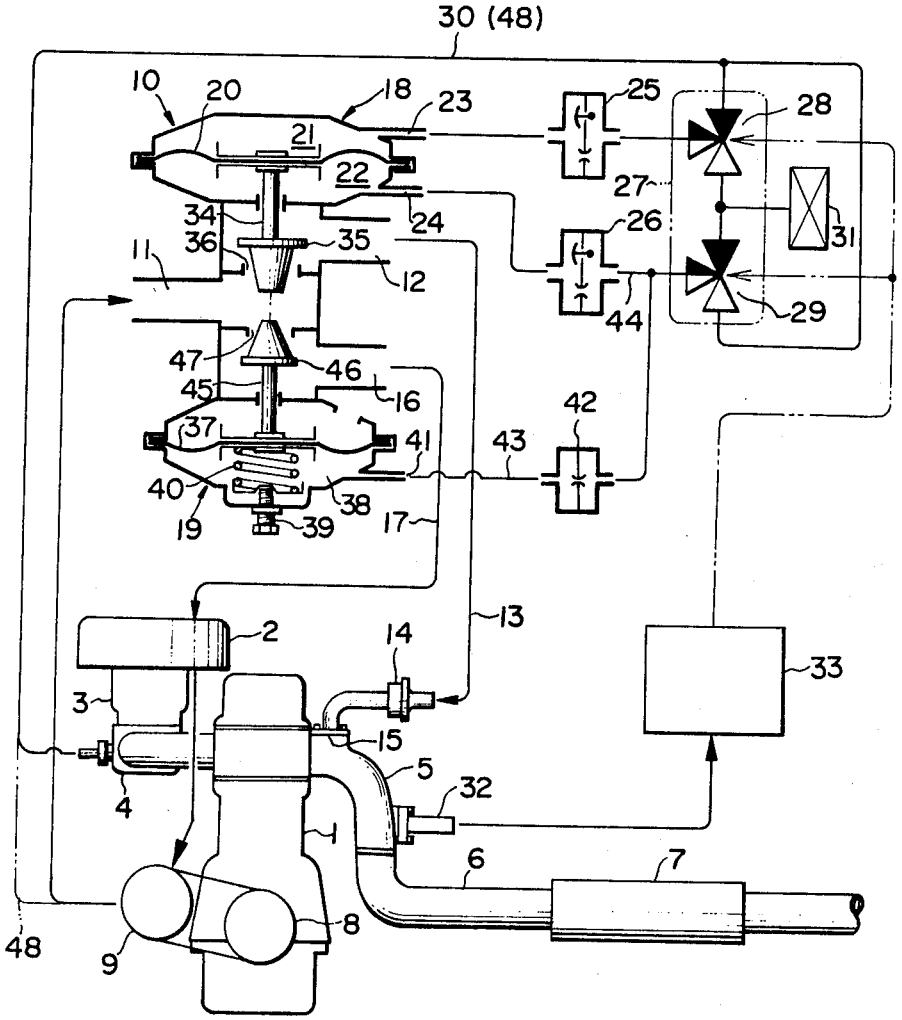
FIG. 1 is a diagrammatical view showing an embodiment of the secondary air supply system for the exhaust system of an internal combustion engine constructed in accordance with the present invention.

Referring to FIG. 1, 1 designates an internal combustion engine which takes in air through an air cleaner 2, a carburetor 3 and an intake manifold 4 and discharges exhaust gases through an exhaust manifold 5 and an exhaust pipe 6 which incorporates at a middle portion thereof a catalytic converter 7 containing a three-way catalyst. The engine generates a rotary power in a crankshaft 8. 9 designates an air pump which is driven by the crankshaft 8 and serves as a source of compressed air to be supplied as secondary air. The air delivered from the air pump 9 is conducted to an inlet port 11 of an air control valve 10, wherein a part of the air is conducted to an outlet port 12 and is further conducted through a passage 13 and a secondary air manifold 14 to be supplied to the exhaust system of the engine through a secondary air supply port 15, whereas the rest of the air received by the air control valve 10 is conducted to a relief port 16 and is further conducted through a passage 17 to be relieved to the atmosphere, or particularly in the shown embodiment to be relieved into the air cleaner 2.

The air control valve 10 has diaphragm means 18 and 19. The diaphragm means 18 has a diaphragm 20 and diaphragm chambers 21 and 22 defined at opposite sides of the diaphragm. The diaphragm chambers 21 and 22 are adapted to be selectively and reciprocally supplied with intake manifold vacuum or atmospheric pressure through ports 23 and 24, vacuum transmission delaying means 25 and 26, each including a throttling element and a check valve in parallel, an actuating fluid change-over valve 27, (which is two changeover valves 28 and 29 in the shown embodiment) respectively, and a passage 30 connected with the intake manifold 4 or an air filter 31. The change-over valve 27 is changed over by a controller 33 which operates in accordance with the output of an oxygen detector 32 which detects residual oxygen contained in the exhaust gases flowing through the exhaust system of the engine. The diaphragm 20 is connected with a valve element 35 by way of a rod 34, which controls a first passage 36 which connects the inlet port 11 and the outlet port 12.

The other diaphragm means 19 of the air control valve 10 has a diaphragm 37 and a diaphragm chamber 38 defined at one side of the diaphragm. The diaphragm 37 is urged upward in the figure by a compression coil spring 40 having one end adjustably supported by an adjusting screw 39. The diaphragm chamber 38 is connected to a middle portion of a passage 44 which connects the change-over valve 29 and the vacuum transmission delaying means 26 through a port 41 and a passage 43 including a throttling element 42. The diaphragm 37 is connected with a valve element 46 by way of a rod 45. The valve element 46 controls a second passage 47 which connects the inlet port 11 and the relief port 16.

Figure 2:
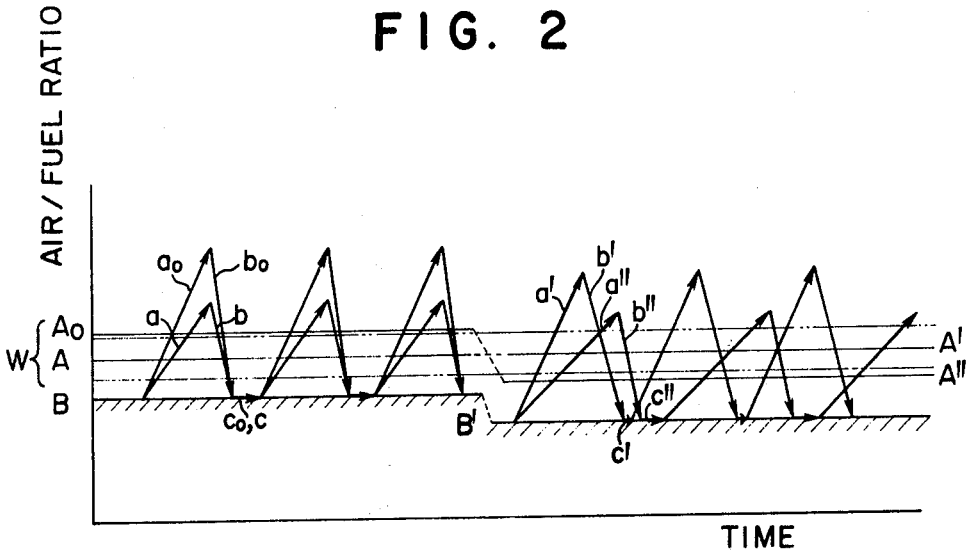
FIG. 2 is a graph showing the secondary air flow performance obtained by the secondary air supply system of the present invention, wherein the secondary air flow performance of a secondary air supply system employing the conventional ON/OFF type air control valve is also shown for the purpose of comparison.

The operation of the secondary air supply system shown in FIG. 1 will be explained with reference to FIG. 2. In FIG. 2 the value B of air/fuel ratio is the basic air/fuel ratio of the exhaust gases discharged from the combustion chambers of the engine to the exhaust manifold 5 in a predetermined standard operational condition of the engine, and is equivalent to the air/fuel ratio of the intake mixture generated by the carburetor in the standard operational condition. W shows a window region centered at the stoichiometric air/fuel ratio and having a range in which the air/fuel ratio of exhaust gases is to be maintained to obtain effective operation of the three-way catalyst.

Now let us assume that the change-over valve 28 is so changed over that the port 23 of the diaphragm means 18 is open to the atmosphere through the air filter 31, whereas the change-over valve 29 is so changed over that the port 24 is connected with the intake manifold 4 through the passage 30. Then, since the fluid pressure in the diaphragm chamber 22 is lower than that in the diaphragm chamber 21, the valve element 35 is shifted downward in the figure so as greatly to throttle or completely to close the passage 36 connecting the inlet port 11 and the outlet port 12. In this condition the flow of secondary air supplied to the exhaust system is reduced or stopped, and therefore the air/fuel ratio of the exhaust gases lowers below the stoichiometric value, with the result that the residual oxygen contained in the exhaust gases flowing through the exhaust system disappears. If the residual oxygen disappears, this is monitored by the oxygen detector 32 and the controller 33 is operated so as to change over the change-over valves 28 and 29 to the opposite positions, so that the port 24 is now opened to the atmosphere through the air filter 31, whereas the port 23 is connected with the vacuum passage 30. By this change-over of the change-over valves, the diaphragm chamber 22 is immediately supplied with atmospheric pressure through the check valve incorporated in the vacuum transmission relaying means 26, while on the other hand the air existing in the diaphragm chamber 21 is gradually drawn out through the throttling element incorporated in the vacuum transmission delaying means 25 and through the passage 30. Therefore, the diaphragm 20 is gradually shifted upward in the figure so that the valve element 35 is also gradually shifted upward in the figure so as gradually to open the passage 36. As the passage 36 is gradually opened, the flow of secondary air which flows from the inlet port 11 to the outlet port 12 and is conducted through the secondary air manifold 14 and the secondary air supply port 15 to be supplied into the exhaust system gradually increases, thereby gradually increasing the air/fuel ratio of exhaust gases.

By this operation of the air control valve, the air/fuel ratio of exhaust gases changes as shown by path a in FIG. 2. As it approaches the end of the path a, the air/fuel ratio of exhaust gases increases beyond the stoichiometric value, and residual oxygen now appears in the exhaust gases. This is monitored by the oxygen sensor 32, and the controller 33 is operated so as to change over the change-over valves 28 and 29 to the opposite positions. By this changing-over of the change-over valves, the diaphragm chamber 21 is opened to the atmosphere through the air filter 31, whereby the diaphragm chamber 21 is quickly supplied with atmospheric air through the check valve incorporated in the vacuum transmission relaying means 25 so that the pressure in the diaphragm chamber 21 is quickly restored to atmospheric pressure. On the other hand, although the port 24 is immediately connected with the vacuum passage 30 by the changing over of the change-over valve 29, drawing-out of air from the diaphragm chamber 22 is delayed by the vacuum transmission delaying means 26, so that the pressure in the diaphragm chamber 22 gradually lowers. Therefore, the diaphragm 20 is gradually shifted downward in the figure with the valve element 35 being also gradually shifted downward in the figure so as gradually to reduce the opening of the passage 36 thereby gradually reducing the flow of secondary air. By this operation of the air control valve, the air/fuel ratio of exhaust gases changes as shown by path b in FIG. 2. After the path b the flow passage 36 is generally maintained for a while in the full closed condition due to the delay of response, so that no secondary air is supplied and the air/fuel ratio of exhaust gases is maintained at the basic air/fuel ratio as shown by path c in FIG. 2. Thereafter, the paths a, b, and c are repeated, and the air/fuel ratio of exhaust gases varies, as shown, in a triangular wave.

While the paths a, b, and c are stably repeated, the valve element 46 is stably maintained at a position by the diaphragm means 19, said position being, for example, a position such as shown in FIG. 1 which provides a medium opening of the passage 47. The position of the valve element 46 is determined by the balance of the vacuum existing in the diaphragm chamber 38 and the spring force of the compression coil spring 40. The diaphragm chamber 38 is connected to a middle portion of the passage 44 which supplies alternatively intake manifold vacuum or atmospheric pressure to the diaphargm chamber 22 in accordance with changing-over of the changeover valve 29 through the throttling element 42 which has a relatively high throttling ratio, and therefore the diaphragm chamber 38 holds a vacuum which is reduced from the intake manifold vacuum in proportion to the duty ratio of the mode of operation of the change-over valve 29 which connects the diaphragm chamber 22 to the vacuum passage 30, i.e. the ratio of the time during which the diaphragm chamber 22 is connected to the vacuum passage 30 in one cycle of the changing-over of the changeover valve 29, to the period of time occupied by one changingover cycle. Therefore, when the basic air/fuel ratio increases so that the duty ratio increases, i.e., when the time during which the diaphragm chamber 22 is connected with the vacuum passage 30 increases relative to the time during which the diaphragm chamber 21 is connected with the vacuum passage 30, the vacuum in the diaphragm chamber 38 increases whereby the diaphragm 37 is shifted downward in the figure against the action of the compression coil spring 40. When the diaphragm 37 is shifted downward so that the valve element 46 is shifted downward in the figure, the passage 47 is more opened, whereby a large part of the air supplied from the air pump 9 to the inlet port 11 is relieved through the relief port 16 thereby reducing the flow of secondary air conducted through the outlet port 12 toward the exhaust system. On the contrary, when the basic air/fuel ration lowers so that the aforementioned duty ratio decreases, i.e., when the time during which the diaphragm chamber 22 is connected with the vacuum passage 30 decreases relative to the time during which the diaphragm chamber 21 is connected with the vacuum passage 30, the vacuum in the diaphragm chamber 38 decreases, whereby the diaphragm 37 is shifted upward in the figure by the action of the compression coil spring 40, thereby more restricting the passage 47 connecting the inlet port 11 and the relief port 16 so that the flow of air relieved is reduced and the flow of secondary air introduced into the exhaust system is increased.

The abovementioned operation of the diaphragm means 19 and the valve element 46 driven by the diaphragm means is such that when the valve element 35 driven by the diaphragm means 18 more restrict the flow of secondary air conducted through the outlet port 12 to be supplied into the exhaust system, the flow of air relieved from the relief port 16 is increased so that the restricting effect applied to the secondary air by the valve element 35 is promoted, and furthermore is such that, on the contrary, when the valve element 35 increases the flow of secondary air conducted through the outlet port 12 to be supplied into the exhaust system, the flow of air relieved form the relief port 16 is reduced so that increase of the flow of secondary air conducted through the outlet port 12 toward the exhaust system is promoted. Now it is assumed that (with reference to FIG. 2) the basic air/fuel ratio has lowered from the standard basic air/fuel ratio B to a lower level such as shown by B'. When the basic air/fuel ratio lowers from the level B to the level B', a larger flow of secondary air is required in order to maintain the mean air/fuel ratio within the window region W. Threrefore, in order to increase the opening of the passage 36 as a whole, the changing-over period of the change-over valves 28 and 29 is automatically modified so that the time during which the diaphragm chamber 21 is connected with the vacuum passage 30 is increased relative to the time during which the diaphragm chamber 22 is connected with the vacuum passage 30 (therefore the time during which the diaphragm chamber 38 is opened to the atmosphere through the air filter 31 is increased relative to the time during which the diaphragm chamber 38 is connected with the vacuum passage 30) and therefore the aforementioned duty ratio with regard to the actuating fluid change-over valve 27 decreases, resulting in a decrease of vacuum in the diaphragm chamber 38, so that the diaphragm 38 is shifted upward in the figure by the action of the compression coil spring 40, whereby the valve element 46 more restricts the passage 47 so as to reduce the flow of air relieved through the relief port 16. By this modification of the flow of air relieved, even when the ON/OFF control of the passage 36 by the valve element 35 is in the same condition as at the standard basic air/fuel ratio B, an increased flow of secondary air is supplied to the exhaust system. By this modification of the flow of air relieved, even when the basic air/fuel ratio is actually lowered from the level B to the level B', the operation of the diaphragm means 18 and the valve element 35 driven by the diaphragm means 18 is substantially not changed, while in accordance with the lowering of the basic air/fuel ratio the changing speed of air/fuel ratio increases, resulting in the air/fuel ratio control by the valve element 34 showing paths a', b', and c' and responsiveness and mean air/fuel ratio A' similar to those obtained for the standard basic air/fuel ratio B being obtained. In FIG. 2, for the purpose of comparison, the paths of air/fuel ratio of exhaust gases obtained by a conventional secondary air supply system for the standard basic air/fuel ratio B and for the lowered basic air/fuel ratio B' are shown as paths ao, bo, and co, and a", b", and c". Similarly, the mean air/fuel ratios for the standard and lowered basic air/fuel ratio are shown by Ao and A", respectively. In this case the mean air/fuel ratio Ao and A" fluctuate greatly up and down the window region W, whereby the effectiveness of the three-way catalyst is greatly reduced, and, since its oscillation period necessarily increases, the responsiveness of the system is deteriorated.

Figure 3:
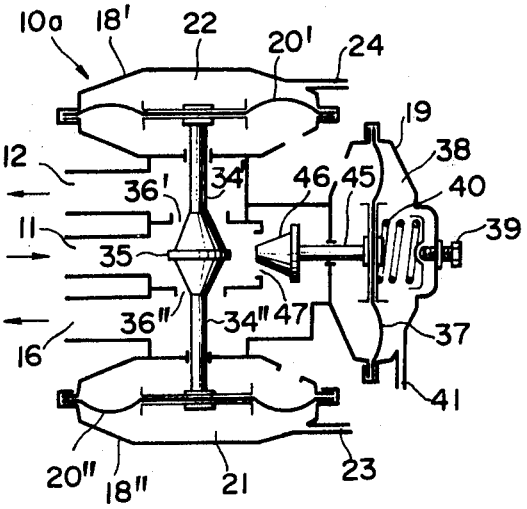
FIG. 3 is a diagrammatical view showing another embodiment of the air control valve incorporated in the secondary air supply system shown in FIG. 1.

FIG. 3 is a diagrammatical sectional view showing another embodiment of the air control valve such as 10 in FIG. 1. In FIG. 3 the portions corresponding to those shown in FIG. 1 are designated by the same reference numerals, whereas the portions which corresond to those shown in FIG. 1 but have been separated into two parts are designated by the corresponding numerals modified by ' and ". It will be apparent that by substituting an air control valve such as 10*a* shown in FIG. 3 for the air control valve 10 incorporated in the secondary air supply system shown in FIG. 1, the air/fuel control as explained above is performed in the same manner.

Although it has been explained that the diaphragm chambers 21 and 22 are reciprocally supplied with either intake manifold vacuum or atmospheric pressure as actuating fluid pressure in the above explanations, delivery air pressure of the air pump 9 may be used as the actuating fluid pressure instead of intake manifold vacuum so that the air pressure conducted through a passage 48 to the actuating fluid change-over valve 27 and atmospheric pressure are reciprocally supplied to the diaphragm chambers 21 and 22, although in this case the supply of the air pump delivery pressure and atmospheric pressure must be exchanged with each other for the same operation of secondary air supply when compared with the case of employing manifold vacuum as the actuating fluid pressure. Similarly, although the diaphragm means 19 in the shown embodiment is adapted to operate in accordance with changes of vacuum supplied to the diaphragm chamber 38, when the delivery air pressure of the air pump is used as the actuating fluid pressure for operating the diaphragm means 18, the diaphragm chamber 38 is supplied with a positive pressure modified from the air pump delivery pressure in accordance with the aforementioned duty ratio. In this case a compression coil spring will be required at the side of the diaphragm 37 opposite to the compression coil spring 40. Then the diaphragm means 19 will be able to perform the same compensating action with respect to changes of the basic air/fuel ratio. In this case, the compression coil spring 40 may be removed, or alternatively the compression coil spring 40 may be retained while the aforementioned other compression coil spring is adapted to be stronger than the compression coil spring 40 so that the biasing force exerted on the diaphragm 37 downward in the figure is adjusted by adjusting the force of the compression coil spring 40 by the adjusting screw 39.

Although the invention has been shown and described with respect to some preferred embodiments thereof, it should be understood by those skilled in the art that various changes and omissions of the form and the detail thereof may be made therein without departing from the scope of the invention.

I claim:

1. A secondary air supply system for the exhaust system of an internal combustion engine, comprising a source of compressed air, an air control valve which supplies a part of the air delivered from said source to the exhaust system of the engine while relieving the rest of the air, an oxygen detector for detecting residual oxygen contained in the exhaust gases flowing through the exhaust system, a source of actuating fluid pressure, a change-over valve for said actuating fluid pressure, and a controller which changes over said change-over valve in accordance with the output of said oxygen detector, said air control valve having an inlet port for receiving air from said source of compressed air, an outlet port for supplying a part of the air received to the exhaust system, a relief port for relieving the rest of the air received, a first passage which connects said inlet port and said outlet port, a second passage which connects said inlet port and said relief port, a first valve element which controls said first passage, a second valve element which controls said second passage, first, second, and third diaphragm chambers, said first and second diaphragm chambers being reciprocally supplied with either said actuating fluid pressure or atmospheric pressure by way of said change-over valve, a passage means including a throttling means and connecting said third diaphragm and one of said first and second diaphragm chambers, at least one first diaphragm which defines said first and second diaphragm chambers and is connected with said first valve element, a second diaphragm which defines said third diaphragm chamber and is connected with said second valve element, wherein said first diaphragm is adapted so as to shift said first valve element in the direction to increase the opening of said first passage when the fluid pressure in said first diaphragm chamber is lower than the fluid pressure in said second diaphragm chamber, and said second diaphragm responds to the fluid pressure in said third diaphragm chamber which varies in accordance with the duty ratio of changing over of said change-over valve and is adapted so as to shift said second valve element in the direction to decrease the opening of said second passage when the duty ratio of the mode of changing-over for supplying lower fliud pressure to said first diaphragm chamber and higher fluid pressure to said second diaphragm chamber increases.

2. The secondary air supply system of claim 1, wherein said air control valve has first and second diaphragm means, said first diaphragm means including a first diaphragm, said first and second diaphragm chambers being defined at opposite sides of said first diaphragm, a first valve stem connecting said first diaphragm with said first valve element; said second diaphragm means including said second diaphragm, said third diaphragm chamber being defined at one side of said second diaphragm, and a second valve stem connecting said second diaphragm and said second valve element.

3. The secondary air supply system of claim 2, wherein said second diaphragm means further comprises a compression coil spring disposed in said third diaphragm chamber so as to urge said second diaphragm in the direction to increase the volume of said third diaphragm chamber and an adjusting screw which adjustably supports one end of said spring.

4. The secondary air supply system of claim 1, wherein said air control valve comprises first, second, and third diaphragm means, said first diaphragm means including a first diaphragm, said first diaphragm chamber being defined at one side of said first diaphragm, and a first valve stem connecting said first diaphragm and said first valve element, said second diaphragm means including a further diaphragm, said second diaphragm chamber being defined at one side of said further diaphragm, and a second valve stem connecting said further diaphragm and said first valve element, and said third diaphragm means including said second diaphragm, said third diaphragm chamber being defined at one side of said second diaphragm, and a third valve stem connecting said second diaphragm and said second valve element.

5. The secondary air supply system of claim 4, wherein said third diaphragm means further comprises a compression coil spring disposed in said third diaphragm chamber so as to urge said second diaphragm in the direction to increase the volume of said third diaphragm chamber, and an adjusting screw which adjustably supports one end of said compression coil spring.

* * * * *